US005790024A

United States Patent [19]

Ripingill, Jr. et al.

[11] Patent Number: 5,790,024

[45] Date of Patent: Aug. 4, 1998

[54] INTRUSION MONITORING SYSTEM

[75] Inventors: Allen E. Ripingill, Jr.; Jon McQuillen, both of San Diego, Calif.

[73] Assignee: Blocker Corporation, San Diego, Calif.

[21] Appl. No.: 925,056

[22] Filed: Sep. 8, 1997

[51] Int. Cl.[6] ..... G08B 13/00

[52] U.S. Cl. ..... 340/565; 340/539; 340/692

[58] Field of Search ..... 340/556, 567, 340/539, 524, 692, 825.69, 825.57, 825.62, 565, 691, 825.4, 578; 359/143, 145

[56] References Cited

U.S. PATENT DOCUMENTS

| | | | |
|---|---|---|---|
| 3,848,231 | 11/1974 | Wootton | 340/539 |
| 4,692,742 | 9/1987 | Raizen et al. | 340/539 |
| 5,499,013 | 3/1996 | Konotchick | 340/539 |
| 5,570,079 | 10/1996 | Dockery | 340/567 |
| 5,677,673 | 10/1997 | Kipnis | 340/539 |
| 5,686,886 | 11/1997 | Stensney | 340/539 |

*Primary Examiner*—Jeffery A. Hofsass
*Assistant Examiner*—Anh La
*Attorney, Agent, or Firm*—Frank D. Gilliam

[57] ABSTRACT

A single or a plurality of like transmitters are remotely positioned from a single receiver. Each one of the transmitters has an infra-red sensor that when activated by the heat of a moving object transmits a first single pulse to set the AGC of the single receiver and then when the AGC level is established transmits a series of coded identification pulses at substantially the same gain level as the first pulse to the receiver. The coded pulses identify one of a plurality of channels in the receiver that contain a pre-recorded message relating to the transmitting transmitter. When a channel is selected that pre-recorded message is audible produced by the receiver. Typically, the message will announce the location of the transmitting transmitter to a listener which indicates that there is an intruder detected at the transmitter location.

10 Claims, 6 Drawing Sheets

INTRUSION MONITORING SYSTEM

The invention is directed to an Infra Red heating sensing intrusion monitoring system which includes a plurality of transmitters each of which is remotely spaced from each other and a single receiver. When a transmitter is activated by sensing a localized heat source, the receiver recognizes the specific transmitting transmitter and acknowledges receipt therefrom by audibly announcing a pre-recorded message related to the transmitting transmitter.

Infra red detectors have been long utilized by the military for heat seeking devices such as, enemy aircraft, enemy ships, etc.

Infra Red detectors are commonly utilized for detecting heat sources within their range and the heat sensing is utilized for a number of purposes such as, but not limited to, actuating alarms, lights, etc. or for any purpose where an object producing heat is to be sensed.

Infra red detectors are generally hard wired to the device that they activate rather than in communication with a device to be activated via radio waves.

SUMMARY OF THE INVENTION

The intrusion device of the present invention includes a infra red sensing device that activates an associated transmitter which is normally on stand by power when movement of a heated object is detected. The transmitter transmits a first pulse at a predetermined amplitude level to a remotely located active receiver which receives the first pulse which establishes an AGC level within the receiver. Shortly after the first pulse, a time delay to insure that the receiver AGC level is determined, the transmitter transmits a serial coded pulse signal to the receiver which activates one of a plurality of internal receiver channels each channel of which includes a pre-recorded message specific to that transmitter indicating to the receiver the transmitting transmitter's location or any other selected information about that transmitter.

The system of the invention comprises one or more like transmitters each of which has its own coded channel within the receiver that can be activated only by a specific coded signal from a given transmitter. Generally the range between the transmitter or transmitters and the receiver is about 300 feet maximum to comply with government non-licencing rules. Obviously, this range can be extended with more powerful transmitters operating under approved government rules.

Low wattage transmitters are also utilized to conserve transmitter operating power so that they can remain portable. The operating power is generally self contained such as, by internal batteries or the like. Solar cells associated with the transmitters can be used to maintain battery power in a conventional manner. Fixed in position transmitters can be AC powered from a convenience outlet through an appropriate transformer and rectifier.

An object of this invention is to provide an Infra Red detecting system for detecting the presence of a heat producing moving object and transmitting a coded alert signal to a receiver via an RF link when the moving heat producing object is within range of a given Infra Red sensor.

Another object of the invention is to provide a receiver that can monitor one at a time a plurality of Infra Red detecting systems spaced from each other and from the receiver.

Still another object of this invention is to first establish the AGC level of the receiver immediately prior to transmitting a serial coded pulse signal.

Yet another object of this invention is to provide a first single pulse signal followed by a coded signal having a plurality of pulses after a short time delay from transmission of the first pulse signal.

Yet another object of this invention is to produce an audio signal from a receiver when a remote transmitter transmits a coded signal to that receiver.

These and other objects of the invention will be better understood from the following Detailed Description of the preferred embodiment of the Invention, taken together with the attached Drawing Figures:

BRIEF DESCRIPTION OF THE DRAWING FIGURES

DETAILED DESCRIPTION OF THE PREFERRED EMBODIMENT OF THE INVENTION

Figure 1:
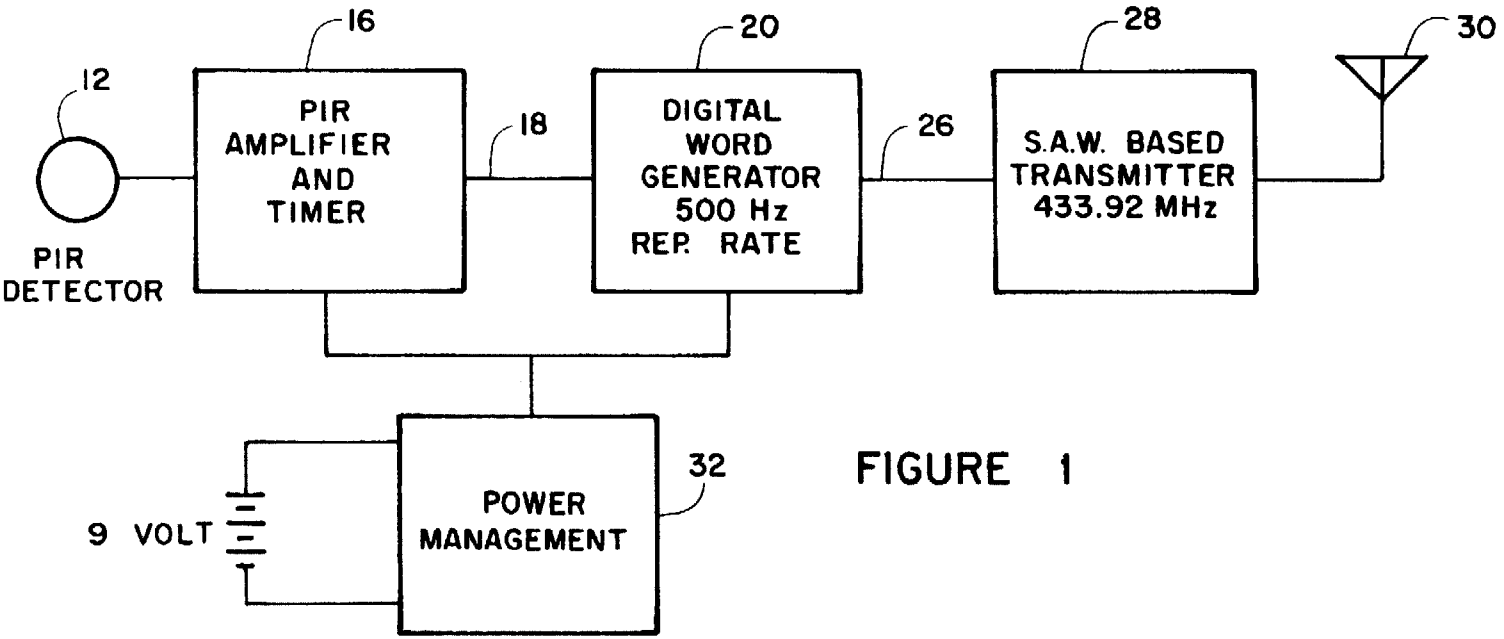
FIG. 1 depicts a block diagram of infra red sensor and associated transmitter of the invention.
Figure 1A:
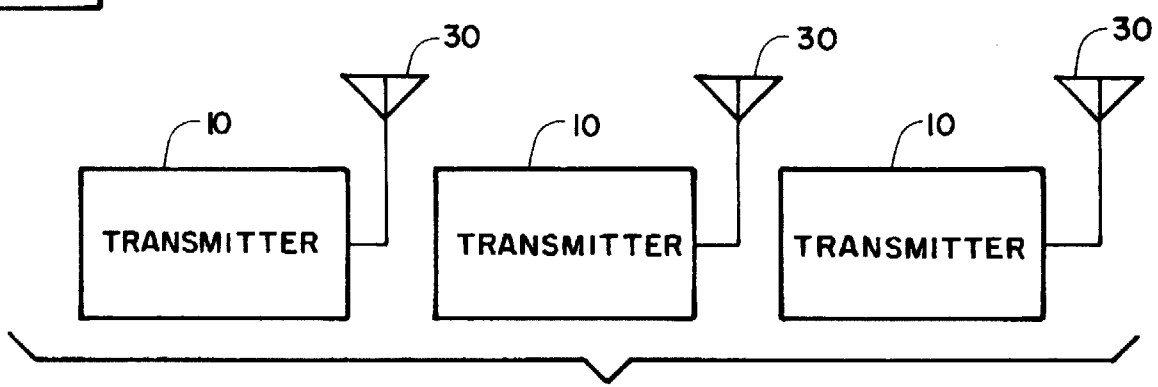
FIG. 1A depicts a plurality of transmitters of FIG. 1.

Referring now specifically to the transmitter section 10 of the invention as shown in FIGS. 1, 1A, 2 and 3. FIG. 1 shows the Infra Red detector 12 of the type Lhi 954 or equivalent manufactured by EG&G Heimann. When localized moving heat is detected by the detector 12, an output signal at 14 provides an input to the signal amplifier and timer chip 16 of the type LS6501 manufactured by LCI/CSI or an equivalent thereto. The output 18 of the amplifier timer chip 16 provides an amplified first pulse signal to the input of a digital word generator 20 of the type PIC16C55, manufactured by Micro Chip or an equivalent thereto. And after a pre-selected time delay the timer provides a serial chain of pulses to be transmitted which identifies the transmitting transmitter.

Figure 2:
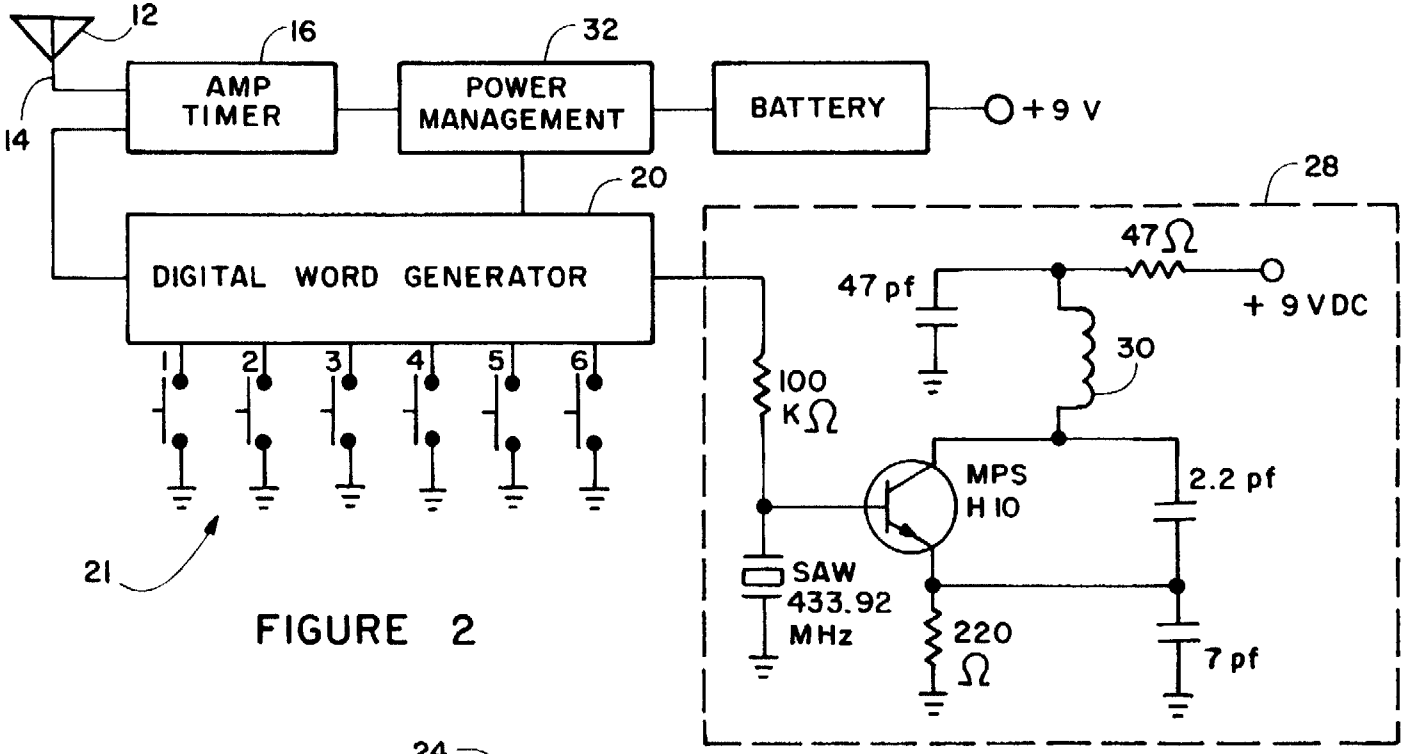
FIG. 2 depicts a partial block and schematic showing of the transmitter of the invention.
Figure 3:
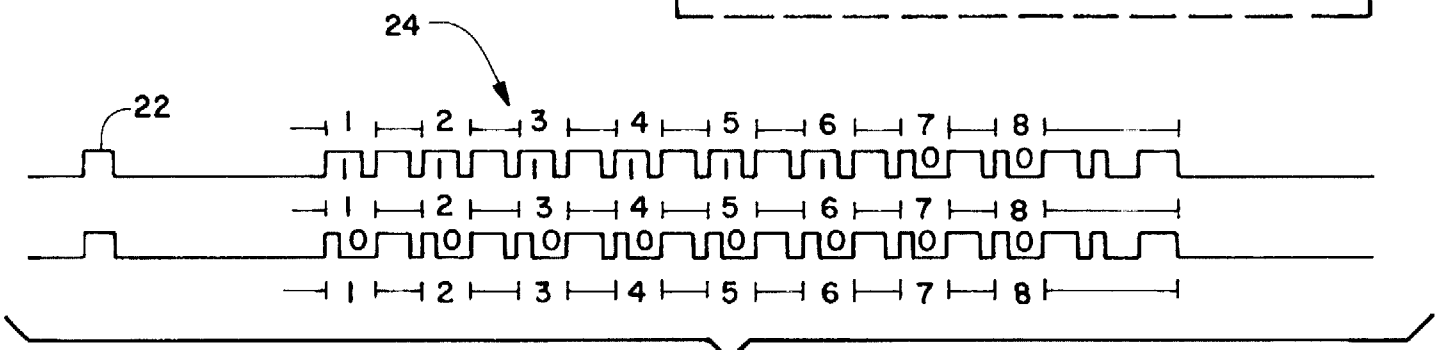
FIG. 3 depicts the first pulse for setting the receiver AGC and the pulse train of the coded signal.

Referring now to FIGS. 2 and 3, the digital word generator 20 includes a plurality of external dip switches 21 for programing the initial single pulse 22 and the transmitter identification serial code 24. The output 26 from the digital word generator provides an input to the Surface Acoustic Wave transmitter (SAW) 28. The RF signal from one or more SAWs is transmitted via their antenna to remote receiver 34, see FIGS. 4–4C.

The Amplifier and timer 16 and the word generator are powered by a power management circuit 32 which is included in the Amplifier and timer chip LS6501, or an equivalent thereto whereby standby power is provided to the transmitter and the transmitter is energized only when a signal is detected by the infra red detector 12. The SAWs are each powered by a battery typically of 9 volts which also furnishes power to the power management circuit.

It should be understood that one or more (three shown) of similar transmitters 10 can be employed for transmission to the single receiver 34.

Figure 4:
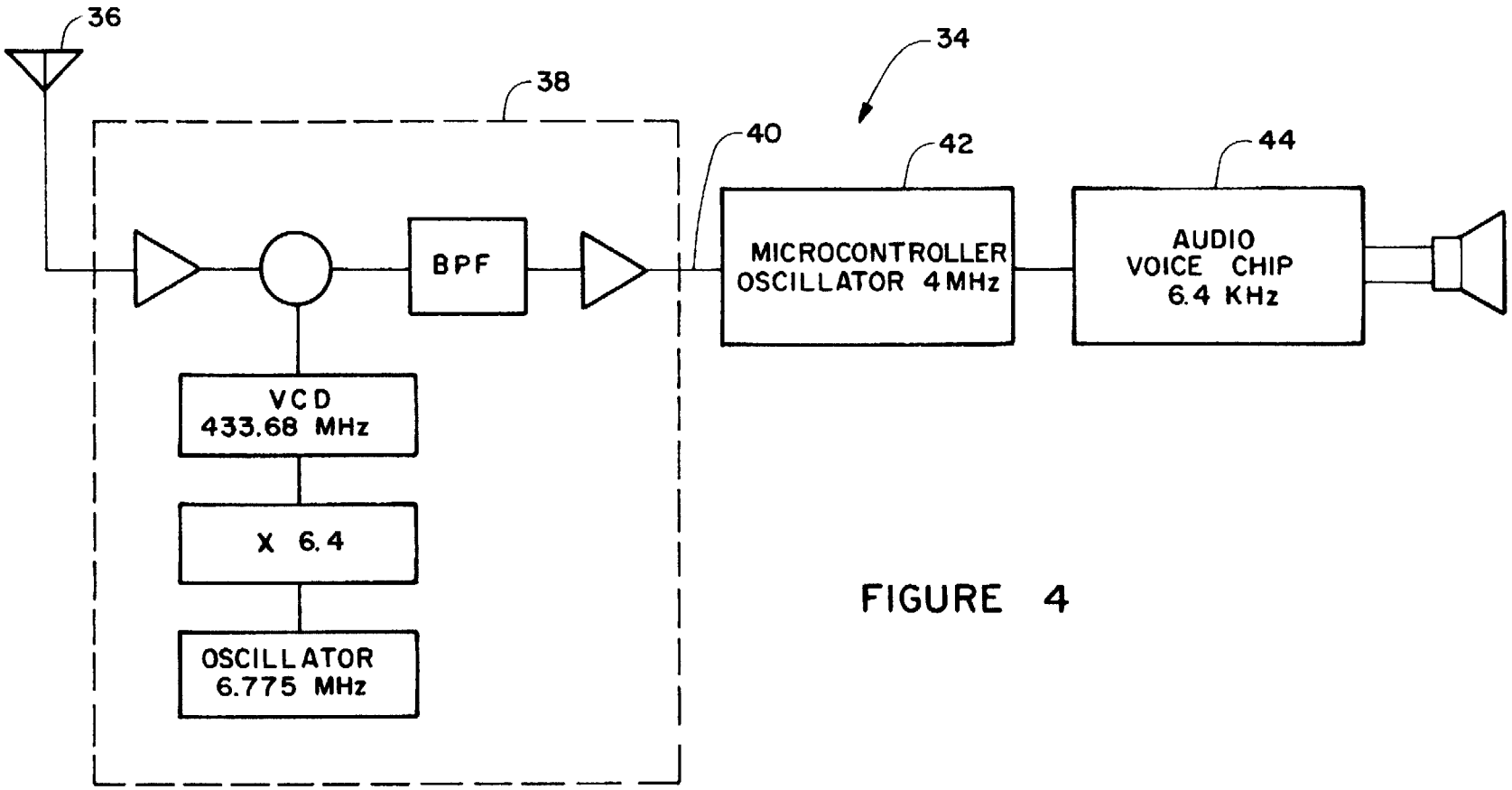
FIG. 4 is a block diagram showing of the receiver of the invention.
Figure 4A:
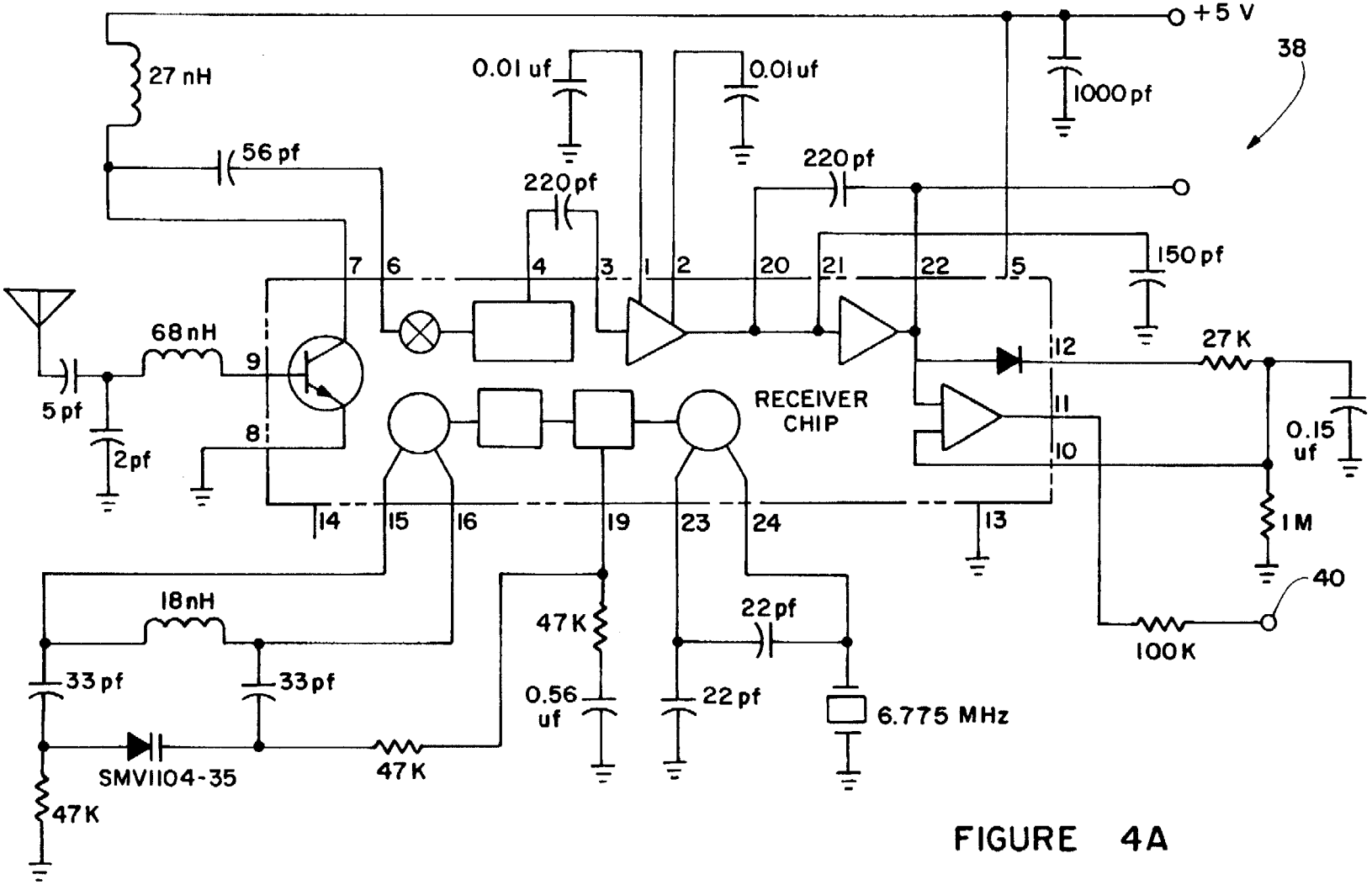
FIG. 4A is a schematic showing of the receiver section of the receiver.
Figure 4B:
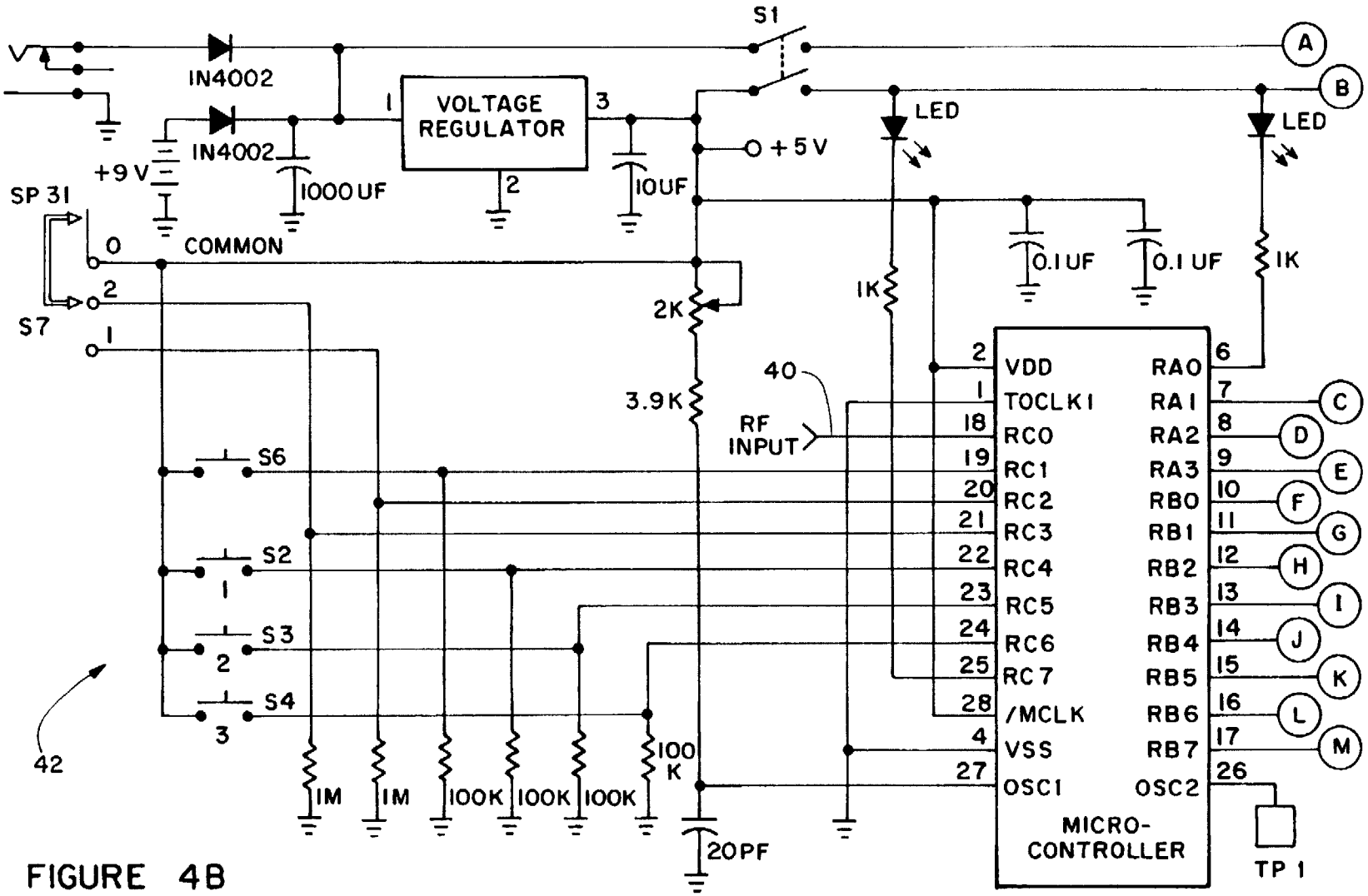
FIG. 4B is a schematic showing of the micro controller oscillator section of the receiver.
Figure 4C:
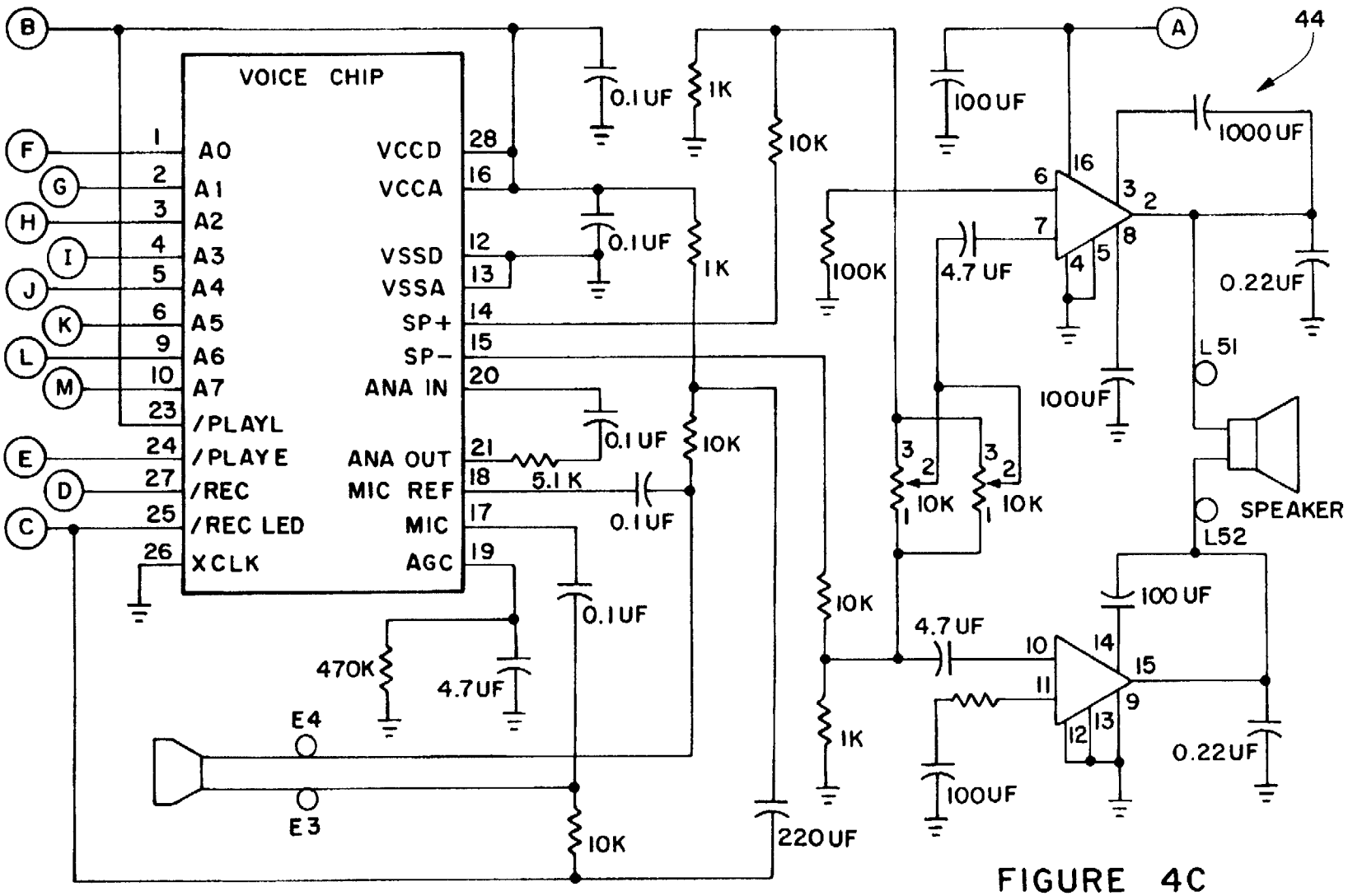
FIG. 4C is a schematic showing of the audio section of the receiver.

Refereeing now to drawing FIGS. 4–4C, the one or more identical transmitters 10 are positioned remote from the receiver 34 and generally from each other. The receiver 34 receives an RF first pulse followed a short time latter by a serial coded signal from any one of the one or more of transmitters 10, each transmitter typically has a different coded signal output, via antenna 36 to a signal receiving section 38 which is typically a superherodyne type receiver the circuit of which is shown in drawing FIG. 4A. Other type receivers may be selected to perform the same function as the superherodyne described. More than one transmitter can have the same coded signal if desired for a specific reason. The output 40 of receiver section 38 provides and input to a micro controller/oscillator 42.

The micro controller oscillator 42 decodes the coded message and provides a signal to an audio section 44 which selects the stored pre-recorded message from the transmitting transmitter 10 and produces an audible output signal corresponding to the pre-recorded message for that transmitter.

The receiver is provided with circuitry for user pre-programming of the messages for each transmitter and can be reprogramed as desired.

The transmitter(s) and receiver as shown in the various drawing Figures are conventionally constructed according to the schematics wherein the various components and their values and/or identification are clearly shown.

Having described one embodiment of the present invention, it should now be apparent to those skilled in the art that numerous other improvements, modifications and embodiments are contemplated as falling within the scope of the present invention. Therefore, this description is to be taken only by way of example and not in any way limit the scope of this invention.

I claim:

1. Intrusion monitoring system comprising:

at least one transmitter comprising an infra red detector for detecting a moving heat signal, said infra red detector having an output signal when detecting a moving heat signal, an amplifier for amplifying said output signal from said infra red detector, said amplifier having an output signal when receiving said output signal from said infra red detector and a transmitter means when receiving an amplified output signal transmitting a first single pulse receiver alert signal and at a predetermined time delay a serial transmitter coded identification signal;

a receiver remotely located from said at least one transmitter having an AGC (Automatic Gain Control) for receiving transmitted signals from said at least one transmitter, the AGC of said receiver being initially stabilized by said first receiver alert signal from said at least one transmitter, said receiver having a plurality of stored separate coded channels each one of which is activated by a separate one of said at least one transmitter coded identification signal, each one of said separate coded channels of said receiver containing a specific prerecorded audio message related to said transmitter coded signal; and means for audibly reproducing said pre-recorded audio message.

2. The invention as defined in claim 1 wherein said at least one transmitter comprises a plurality of remotely spaced apart substantially identical transmitters.

3. The invention as defined in claim 2 wherein said separate coded channels are equal in number to said plurality of transmitters and each of said separate channels when being alerted by at least one of said plurality of transmitters producing an audible message signal.

4. The invention as defined in claim 3 wherein a given audible message denotes the location of a transmitting one of said plurality of transmitters.

5. The invention as defined in claim 1 wherein said first receiver alert signal is a single pulse.

6. The invention as defined in claim 3 wherein said receiver alert single pulse has a predetermined amplitude.

7. The invention as defined in claim 1 wherein said coded identification signal comprise a plurality of pulses in the form of a serial binary code.

8. The invention as defined in claim 7 wherein said pulse receiver alert signal has a predetermined amplitude and said plurality of pulses forming said binary code have substantially the same amplitude as said pulse alert signal.

9. The invention as defined in claim 1 wherein said at least one transmitter is battery powered.

10. The invention as defined in claim 1 further comprising recording means for recording one of said pre-recorded message in each of said channels.

* * * * *